US008800448B2

(12) United States Patent
Frew et al.

(10) Patent No.: US 8,800,448 B2
(45) Date of Patent: Aug. 12, 2014

(54) STAND-OFF DOOR BREACHING DEVICE

(75) Inventors: Danny Joe Frew, Albuquerque, NM (US); Stephen Lance Kinnebrew, Crisfield, MD (US)

(73) Assignee: Dynamic Solutions LLC, Southern Pines, NC (US)

( * ) Notice: Subject to any disclaimer, the term of this patent is extended or adjusted under 35 U.S.C. 154(b) by 185 days.

(21) Appl. No.: 13/368,964

(22) Filed: Feb. 8, 2012

(65) Prior Publication Data

US 2013/0199395 A1 Aug. 8, 2013

(51) Int. Cl.
*F42B 12/74* (2006.01)
*F42B 12/20* (2006.01)

(52) U.S. Cl.
CPC ..... *F42B 12/74* (2013.01); *F42B 12/204* (2013.01)
USPC ..... 102/394; 102/396; 102/481

(58) Field of Classification Search
CPC ..... F42B 12/72; F42B 12/74; F42B 12/76; F42B 12/204; F42B 12/20
USPC ..... 102/394, 395, 396, 275, 481
See application file for complete search history.

(56) References Cited

U.S. PATENT DOCUMENTS 1,632,147 A * 6/1927 Ragsdale ..... 102/395
2,184,028 A * 12/1939 Urban ..... 102/389
3,343,486 A * 9/1967 Patrick ..... 102/395
5,561,261 A * 10/1996 Lindstadt et al. ..... 102/476
2011/0174187 A1 7/2011 Van Stratum

FOREIGN PATENT DOCUMENTS

GB 530 442 A 12/1940
WO WO 00/52415 A1 9/2000

OTHER PUBLICATIONS

International Search Report issued in PCT/US2013/025271 mailed on Nov. 7, 2013.

* cited by examiner

*Primary Examiner* — Stephen M Johnson
(74) *Attorney, Agent, or Firm* — Andrews Kurth LLP; Sean S. Wooden; Matthew J. Esserman

(57) ABSTRACT

A stand-off breaching device, for breaching a target, that includes a nose at a front end which is a rounded cone-shape and configured to cause the stand-off breaching device to rebound from a target after the nose impacts the target, and a body connected to the nose and extending to a back end of the stand-off breaching device. The body includes a main explosive fill that is detonated and explodes to provide an explosive breaching force, and a delay detonator that detonates the main explosive fill and that is triggered when the nose impacts a target. The delay-detonator is configured to delay detonation of the main explosive fill until the stand-off breaching device has rebounded to a determined stand-off distance chosen to cause effective breaching of the target. The nose, body, and their components are fabricated from material that will be substantially consumed by the explosion, minimizing any fragments.

16 Claims, 14 Drawing Sheets

STAND-OFF DOOR BREACHING DEVICE

TECHNICAL FIELD

The technical field is explosive devices for breaching doors, and more particularly stand-off breaching devices that may be thrown or shot from a launcher.

BACKGROUND

Currently, dismounted troops have the capability to effectively breach medium weight steel doors using rifle-launched stand-off breaching devices such as the SIMON device and a similar U.S. Army derivative the GREM. Attempts are currently underway to develop a similar stand-off breaching capability which may be fired from a 40 mm grenade launcher. The 40 mm grenade is known as the Hell Hound. Both of these platforms have their advantages and disadvantages.

The SIMON is effective, but is not a compact device.

Weight: 680 g (including stand-off rod)

Length:

Stand-off rod: 400 mm

Overall: 765 mm (30 inches)

Warhead diameter: 100 mm

Explosive fill:

Standard SIMON: 150 g (PBXN-109)

SIMON 120: 120 g (PBXN-109)

Range: 15-30 meters

One of the most significant disadvantages of the SIMON device, and a significant cause of its lack of compactness, is its stand-off rod. The stand-off rod causes the SIMON device to be at least a certain distance from a door when its explosive detonates.

The 40 mm grenade (Hell Hound) is compact, but its effectiveness is limited by its maximum payload and by the fact that it explodes on impact. A typical Hell Hound grenade has the following characteristics:

Weight: 225 grams

Length: 110 mm (4.3 inches)

Explosive fill: 88 grams (A5)

Range: 400 m

Hell Hound grenades appear to be limited to a maximum explosive fill of less than 90 gram. Furthermore, as noted, the Hell Hound detonates on impact and does not rebound from the target, thereby preventing it from achieving an optimal stand-off distance.

What is needed is a stand-off breaching device that combines the breaching effectiveness of the SIMON device and GREM with the compactness of the Hell Hound. To be effective, such a stand-off breaching device should produce minimal fragmentation and minimal blast hazards for the operator.

SUMMARY

Embodiments described herein have numerous advantages, including overcoming the defects of the prior art described above. These advantages may be achieved by a stand-off breaching device for breaching a target, such as a door. The stand-off breaching device includes a nose at a front end of the stand-off breaching device that is a rounded cone shape, the nose configured to cause the stand-off breaching device to rebound from a target after the nose impacts the target, and a body connected to the nose and extending to a back-end of the stand-off breaching device. The body includes a main explosive fill, in which the main explosive fill is detonated and explodes to provide an explosive breaching force, and a delay detonator that initiates the main explosive fill and that is triggered when the nose impacts a target. The delay detonator is configured to delay the detonation of the main explosive fill until the stand-off breaching device has rebounded to a determined stand-off distance chosen to cause effective breaching of the target. The nose and body, and components of each, are fabricated from material that will be substantially consumed by the explosion of the main explosive fill, minimizing any resultant fragments.

These advantages may also be achieved by a stand-off breaching device for breaching a target, the stand-off breaching device including means for activating means for delayed detonating of the stand-off breaching device, in which said activating means activates said delayed detonating means and causes the stand-off breaching device to rebound from the target upon impact with a target, a main explosive fill, in which the main explosive fill, when detonated, explodes and provides a explosive load on a target, and said delay detonating means, connected to said activating means, in which said delay detonating means detonates the main explosive fill after a delay designed to allow the stand-off breaching device to rebound to a desired stand-off distance from a target. Said activating means and said delay detonating means are substantially consumed by the explosion of the main explosive fill, minimizing any resultant fragments.

BRIEF DESCRIPTION OF THE DRAWINGS

The detailed description may refer to the following drawings, wherein like numerals refer to like elements, and wherein.

DETAILED DESCRIPTION

Figure 1A:
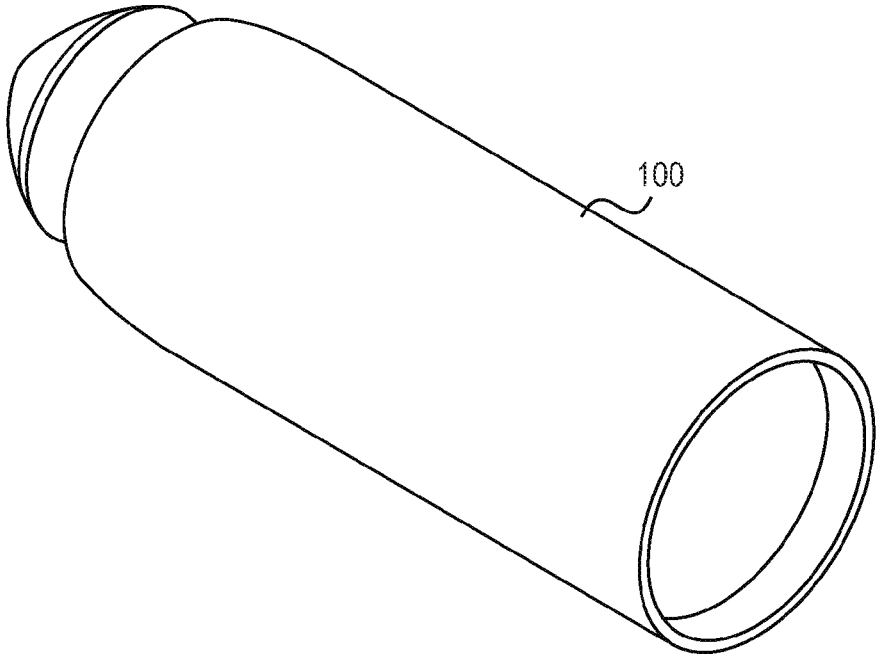
FIGS. 1A to 1D are diagrams illustrating perspective, side, cross-sectional and partially exploded views of an embodiment of a stand-off breaching device.
Figure 1B:
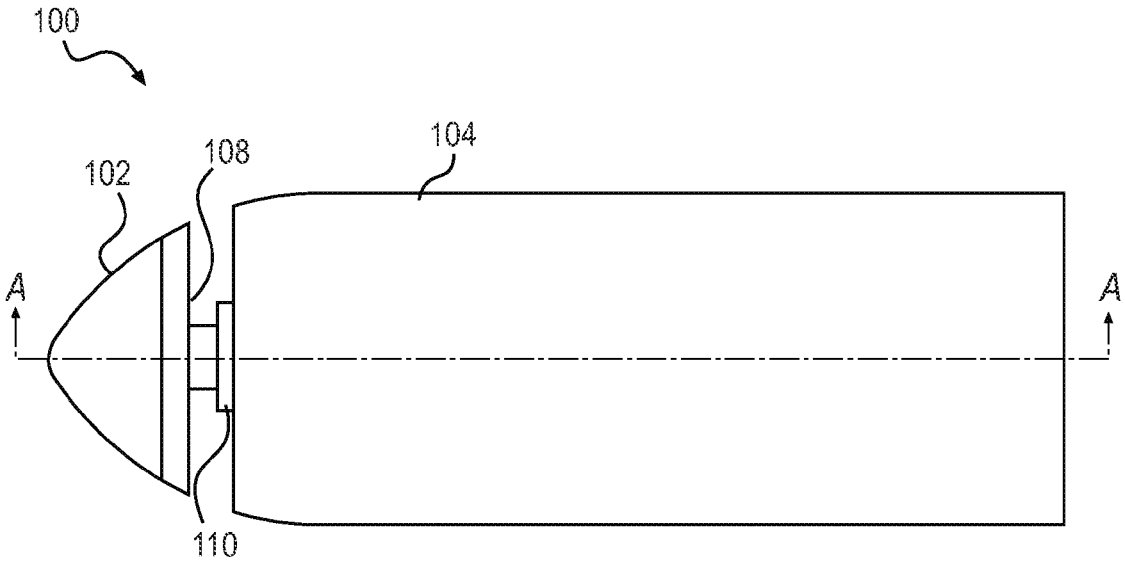

Described herein are embodiments of a stand-off door breaching device and method. In an embodiment, the stand-off breaching device is a stand-off breaching grenade ("SOBG") that may be accurately hand-thrown or launched by a grenade or similar launcher. Embodiments are designed with a delay detonator that is triggered by impact of the stand-off breaching device with a target (e.g., a door to be breached). The stand-off breaching device is also designed to rebound away from the target after impacting the target. In such embodiments, upon impact with the target, the delay detonator is initiated, the stand-off breaching device rebounds away from the target and, after a delay, the stand-off breaching device detonates. Embodiments are designed, and the delay detonator set, so that the stand-off breaching device detonates at some predetermined stand-off distance from the target. The delay-time of the delay detonator, and the speed with which the stand-off breaching device rebounds away from the door, determines the stand-off distance at which the stand-off breaching device detonates. Embodiments are also designed so that substantially all of the stand-off breaching device is consumed by the explosion, minimizing fragmentation and blast hazards.

The embodiments described herein, and indeed most door-breaching explosive devices, are found to most effectively breach a door when the device explodes at a "stand-off" distance away from the door. The desired stand-off distance is the distance at which the explosive loading on the door (the pressure on the door caused by the explosion) is sufficient to force open/breach the door. If the explosion occurs to close to the door, the explosive loading will tend to simply punch a hole in through the door rather than opening the door. If the explosion occurs to far from the door, the explosive loading will not be sufficient to open the door. The embodiments described here are designed to rebound to the effective, desired stand-off distance and explode, explosively loading the door with sufficient force to force the door open. The detonation delay for such embodiments may range from 75 to 100 ms. The stand-off distance for such embodiments may range from 8-14 inches.

The embodiments described herein are also designed to provide the effectiveness of the SIMON and GREM devices with the compactness of the 40 mm Hell Hound. Consequently, embodiments may have a similar amount of explosive fill as the SIMON 120 or even the standard SIMON. The amount of explosive fill used in embodiments of the stand-off breaching device may vary, as discussed in detail below, depending on the intended applications and effectiveness needed. For example, the explosive fill needed for breaching heavy-weight steel doors will necessarily be greater than that needed to breach medium-weight steel doors.

As noted above, embodiments are designed to be accurately and effectively hand-thrown. Such embodiments may have an effective range similar to that of the SIMON and GREM devices. However, the lack of a stand-off rod (which makes the device heavier and less compact and) and the more aerodynamic design of embodiments described here suggests that embodiments of the stand-off breaching device will have a greater effective thrown range than the SIMON and GREM devices. Embodiments of the stand-off breaching device may also be designed to be launched from a grenade launcher or similar device; such embodiments would likely have a similar effectiveness to the Hell Hound grenade.

With reference now to FIGS. 1A-1D, shown are different views of an embodiment of the stand-off breaching device 100. The stand-off breaching device shown is a stand-off breaching grenade (SOBG). FIG. 1A illustrates a perspective side view of SOBG 100. As seen in FIG. 1A, SOBG 100 looks like a standard ballistic shell. The side view shown in FIG. 1B, however, illustrates some clear differences between a standard shell and SOBG 100. For example, SOBG 100 includes a nose 102 and a body 104 with a gap between nose 102 and body 104. This gap, as shown and discussed in detail below, enables nose 102 to compress into body 104 upon impact with target, thereby triggering delay detonator.

Figure 1C:
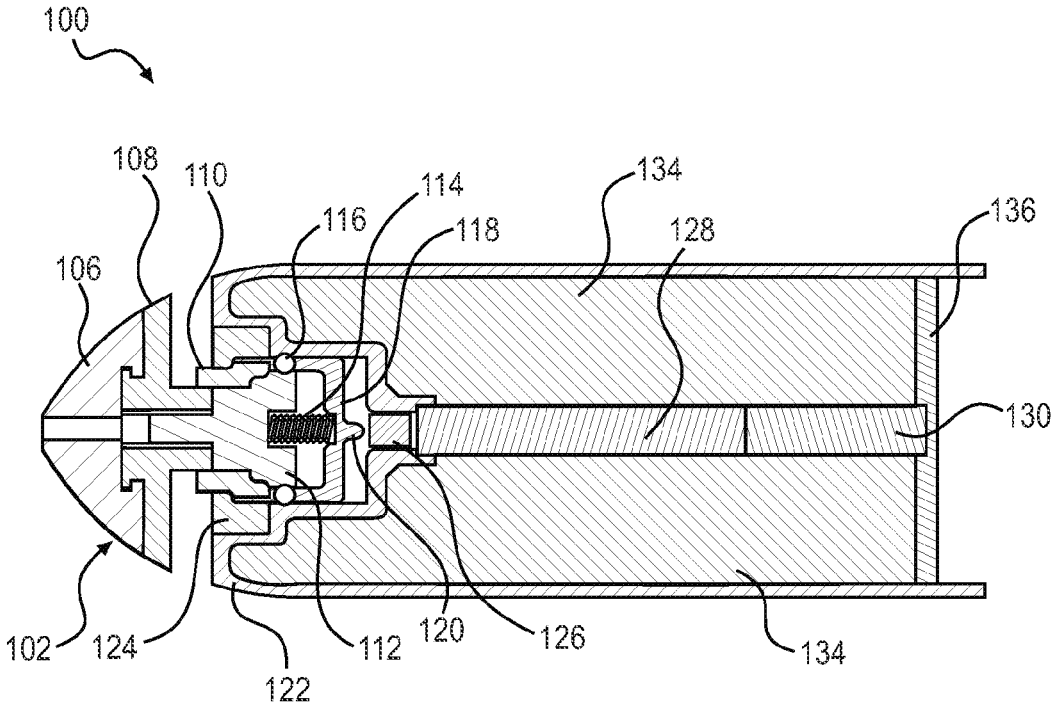

With reference to FIG. 1C, shown is a cross-sectional view of SOBG 100. Nose 102 and body 104 are shown in more detail. In cross-sectional view shown, embodiment nose 102 includes nose bumper 106, safety pin extension 108, safety pin retainer 110, safety pin 112, compression spring 114, ball bearings 116, and firing pin assembly 118. Bumper 106 may be made from material, such as rubber, that will have some give and cause SOBG 100 to bounce away from target after impact of SOBG 100 with target. For example, bumper 106 may be made from vulcanized nitrile rubber or similar material. Upon impact with target, bumper 106 compresses and then rebounds to its original shape, exerting force against target and SOBG 100, causing SOBG 100 to rebound or bounce away from target. Impact with target also causes nose 102 to be forced into body 104, arming SOBG 100 and initiating delay detonator.

Safety pin 112 prevents SOBG 100 from being accidentally armed and detonator triggered prior to throwing of SOBG 100 against target. Safety pin retainer 110 holds safety pin 112 inside safety pin extension 108 which connects safety pin 112 with bumper 106. Together with safety pin extension 108, safety pin 112 and safety pin retainer 110 form a safety pin assembly. Compression spring 114 connects safety pin 112 to firing pin assembly 118 and keeps safety pin 112 separated from firing pin assembly 118 and, therefore, keeps firing pin assembly 118 from triggering delay detonator, during normal handling of SOBG 100. Only when nose 102 impacts a target with sufficient force to move safety pin 112 with sufficient force to overcome inertia of compression spring 114 will compression spring 114 be compressed sufficiently to allow ball bearings 116 to disengage from housing 122 through the outside diameter contour of safety pin 112. With the ball bearings 116 disengaged from housing 122, the firing pin assembly 118 will be forced further into the body 104, impact the primer 126, and initiate the explosive train. Firing pin assembly 118 may include tip 120 (in affect, the firing pin) or other extension that impacts with primer to trigger detonation (see below).

It is noted that nose 102 may have different components than those shown and that the components shown may be shaped or configured differently. Such different components should cooperate and function in a manner consistent with the operation described above so that SOBG 100 does not detonate during routine handling, when thrown or shot at target, triggers delay detonator and bounces off of target upon impact with target, and detonates at ideal stand-off distance sufficient to force open target.

With continuing reference to FIG. 1C, in cross-sectional view shown, embodiment of body 104 includes housing 122, firing pin retainer 124, primer 126, delay detonator delay element 128, delay detonator output/primary charge 130, main explosive fill 134, and back cap 136. Housing 122 contains explosive fill 134 and the other components of body 104. Firing pin retainer 124 retains firing pin assembly 118 inside body 104 of SOBG 100. Primer or percussion cap 126 ignites delay detonator delay element 128. Primer 126 is a low-energy, high-sensitivity explosive triggered by impact of tip 120 of firing pin assembly 118. For example, primer may be a commercial, off-the-shelf ("COTS") primer such as a Remington™209 Premier™ STS™ Primer, or a specifically designed primer.

In an embodiment, delay element 128 is a pyrotechnic delay element that burns. Time that delay element 128 takes to burn provides delay and is configured to delay sufficiently for SOBG 100 to rebound to ideal stand-off distance after impacting with target. Delay element 128, after burning, ignites delay detonator output/primary charge 130. Delay detonator comprises delay element 128 and primary charge 130. Primary charge 130 detonates explosive fill 134 (secondary charge or explosive). Explosive fill 134 then detonates, with explosive shockwave of explosive fill 134 traveling back towards nose 102 of SOBG 100 (and, therefore, towards target). Explosive fill 134 may be a COTS explosive or a specifically designed explosive. In embodiments, explosive is a safety-certified explosive such as PBXN-109. Back cap 136 seals back end of body 104. Back cap 136 shown is configured as flat circular disks that extend through entire circumference of interior (hollow space) of housing 122, although different shapes may be used.

To summarize the delay detonation chain, upon impact of the SOBG 100 with the target, nose 102 pushes firing pin 118 into percussion primer 126. Primer 126 sets off the delay element 128 in the time delay detonator, which burns and then sets off primary charge 130 of delay detonator. Primary chare 130 of delay detonator sets off booster 132, which in turn sets off main explosive fill 134. The time taken by the above-described detonation process provides the delayed detonation describe above. Accordingly, this process is configured by design and set-up to provide sufficient delay for an explosion of SOBG 100 at ideal stand-off distance from target. This configuration, therefore, takes into account amount of 'bounce' achieved by impact of nose bumper 106 on target under ordinary use (i.e., how far SOBG 10 will rebound from target in given amount of time—the rate, allowing for variations in speed of impact (e.g., as thrown by different persons at different speeds or launched by launchers), and ideal stand-off distance for given target type. In an embodiment the detonation delay may range from 75 to 100 ms, while the desired stand-off distance ranges from 8-14 inches. Accordingly, in such an embodiment, SOBG 100 may rebound from the target at about 0.08 to 0.19 inches per ms after impacting the target.

This rate of rebound and, therefore, the detonation delay, will vary depending on numerous factors including whether SOBG 10 is thrown or launched, how hard it is thrown, the weight of SOBG 10, aerodynamic variations, etc. Likewise, the desired stand-off distance may differ based on the target, the explosive used and other factors. Ideally, these factors are all taken into account when designing and calibrating an implementation of SOBG 10 or other stand-off breaching device according to the present invention.

It is noted that the amount of main explosive fill 134 and the location of back cap 136 are not limited to what is shown in the accompanying drawings. More or less main explosive fill 134, for example, may be provided depending upon the intended target and use of SOBG 100. If greater explosive loading is needed, more explosive fill 134 may be used, and vice-versa. Furthermore, the affect of the amount and weight of main explosive fill 134 on the throwing balance of SOBG 100 may dictate that less or lighter main explosive fill 134 be used. For example, explosive fill 134 that extends to back cap 136 may cause the center of gravity of SOBG 100 to be to far to the back of SOBG 100, causing SOBG 100 to tumble in flight. In such circumstances, the amount of main explosive fill 134 may need to be reduced, lighter explosive fill may need to be used or counter-balances (e.g., heavier materials used or additional counter-balancing components added) included in the front of SOBG 100.

Accordingly, in an embodiment, main explosive fill 134 does not extend all the way to back cap 136. Such an embodiment may include an interior back cap that encloses main explosive fill 134 and creates an empty space between end of main explosive fill 134 and back cap 136. In such an embodiment, delay detonator may be shorter so that it does not extend beyond interior back cap and end of main explosive fill 134. Alternatively, if delay detonator extends to back cap 136 as shown, a booster that surrounds primary charge 130 of delay detonator may be provided. In such an embodiment, explosive booster acts as a bridge between delay detonator and explosive fill 134. Booster may wrap around primary charge 130 of delay detonator. Booster may be a COTS booster or specifically designed booster. In embodiments, the booster material is a safety-certified booster material. Booster is ignited by detonation of delay detonator primary charge 130, increasing explosive shockwave to degree sufficient to detonate main explosive fill 134.

Likewise, as noted, SOBG 100 may be designed to be hand-thrown or fired from a launcher. Accordingly, SOBG 100 be made built to a size comfortable for an average soldier to throw. The length, width and weight of such an embodiment of SOBG 100 should probably be on the same scale as an ordinary grenade, although perhaps a bit larger in all aspects since a SOBG 100 usually does not need to be thrown as far. In an embodiment, SOBG 100 is of a size and shape that is compact, so that it may be easily carried, and can be easily thrown by hand from a distance ranging from 5 to 10 meters. For such an embodiment, the expected safe usage distance of the SOBG 100 will be 5 to 10 meters. If designed to be fired, SOBG 100 may be larger in at least weight, although it will be restricted by launch capabilities of launcher. SOBG 100 may, therefore, be designed to fit within a launcher. Alternatively, an extension may be fitted to back-end of body 106 to fit inside launcher. In this manner, extension may extend out of back-end of body 106 into launcher when SOBG 100 is prepared for use. Back cap 136 may be configured to accept extension. As SOBG 100 may have its own launch tube attachment or system, SOBG 100 is not restricted to the 40 mm diameter or maximum length of the 40 mm grenade. Further, SOBG 100 weight may be increased because SOBG 100 will be launched at a much lower velocity than a standard 40 mm grenade because SOBG 100 needs to impact at a relatively low velocity to rebound (too fast a velocity and SOBG 100 will simply pass through some light-weight doors).

With continuing reference to FIG. 1C, components of SOBG 100 are designed to be substantially consumed by explosion, thereby reducing or eliminating fragmentation effects. Consequently, material used to make components of nose 102 and body 104 described herein may be a plastic or other consumable material. For example, components may be made from polyoxymethylene ("POM"), an engineering thermoplastic. POM, also known as acetal, polyacetal, and polyformaldehyde, is known for is high-strength, hardness and rigidity and is readily used to manufacture precision parts. POM parts have been shown to be generally completely consumed by explosion of explosive fill 134. A number of commercial suppliers of POM exist, including DuPont (Delrin™), Ticona (Hostaform™), Polyplastic (Duracon™), Korea Engineering Plastics (Kepital™), Mitsubishi (Lupital™) and BASF (Ultraform™). Other plastics or materials that may be used to fabricate precision parts such as components described above, that will be readily consumed by explosion of explosive fill 134, and that do not otherwise produce hazardous effects, may be used.

Figure 1D:
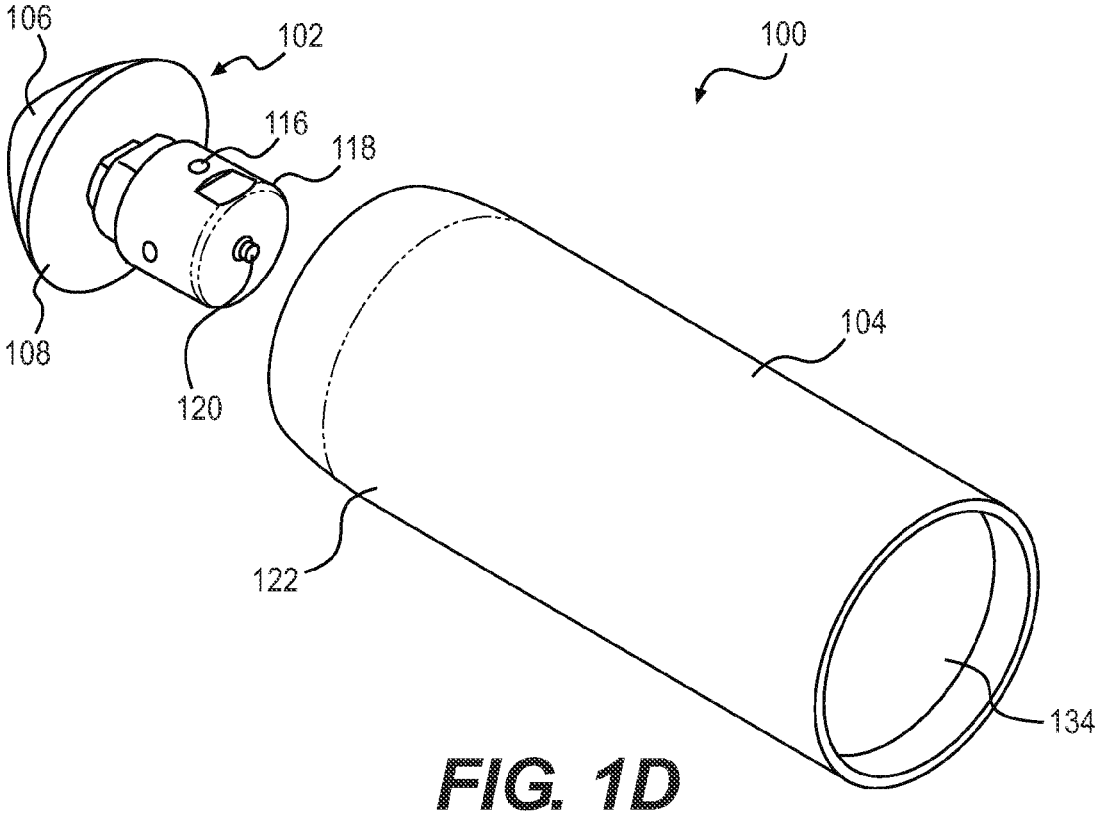
Figure 2:
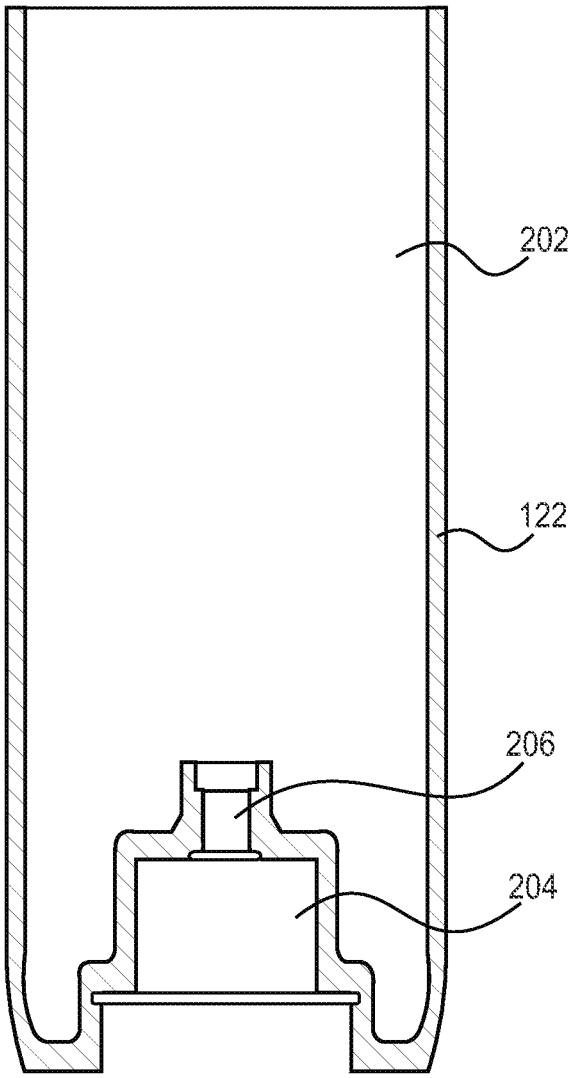
FIG. 2 is a diagram illustrating a cross-sectional view of a body of an embodiment of a stand-off breaching device.

With reference now to FIG. 1D, shown is a perspective side view of embodiment of SOBG 100 with nose 102 removed from body 104. Bumper 106, safety pin extension 108, ball bearings 116, firing pin assembly 118 and tip 120 of nose 102 may be seen. Housing 122 and back cap 136 of body 104 may be seen With reference now to FIG. 2, shown is a cross-sectional view of an embodiment of housing 122. Housing 122 shown does not include firing pin retainer, primer, booster, main explosive fill, first back cap or second back cap. In an embodiment, these components are fabricated/manufactured separately from housing 122. After fabrication, the components may be assembled with and installed in housing 122 to form body 104. As shown, housing 122 defines a main cavity 202, a firing pin cavity 204 and a primer cavity 206. Main cavity 202 is hollow space, surrounded on all but open bottom or back of housing 122 by walls of housing 122, in which main explosive fill, delay detonator, booster, and back cap are placed. Firing pin cavity 204 is hollow space, surrounded by walls of housing 122 except at open top or front of housing 122 and at primer cavity 206 location, where firing pin retainer 124 and firing pin assembly 118 of nose 102 are placed. Primer cavity 206 is hollow space, connecting main cavity 202 and firing pin cavity 204, in which primer 126 is placed. Primer cavity 206 may be designed to securely hold primer 126 in place.

Figure 3B:
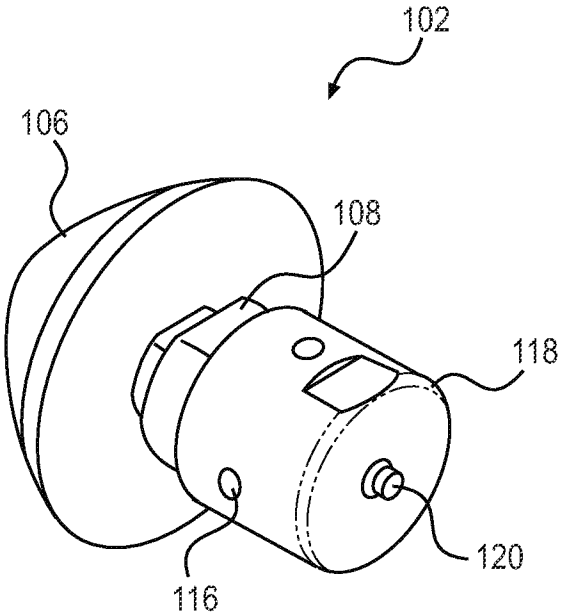
FIGS. 3A to 3D are diagrams illustrating a perspective front, perspective rear, side and exploded views of a nose of an embodiment of a stand-off breaching device.
Figure 3A:
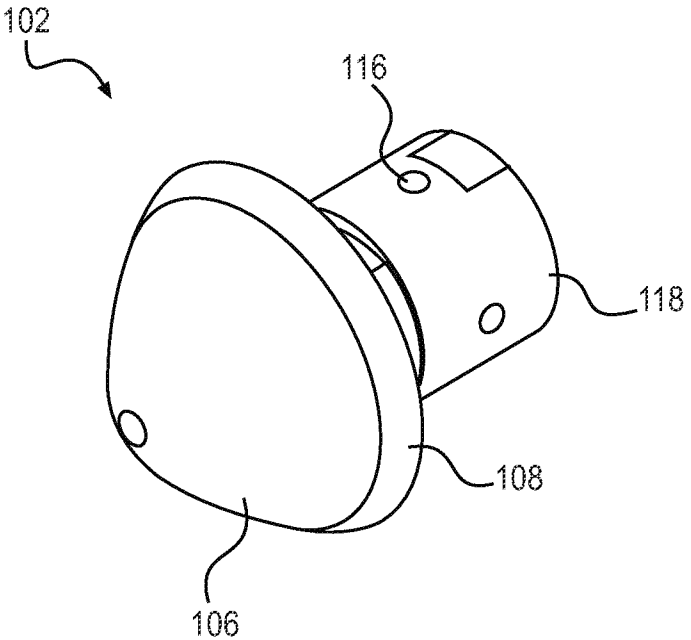
Figure 3D:
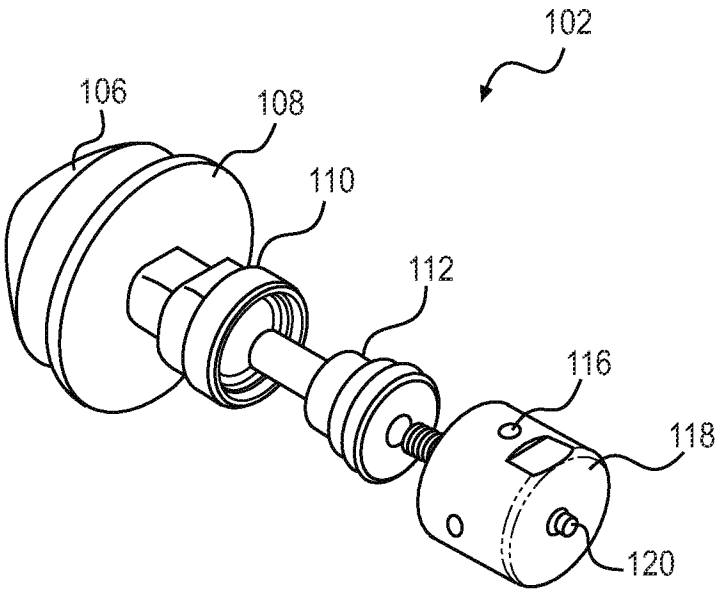
Figure 3C:
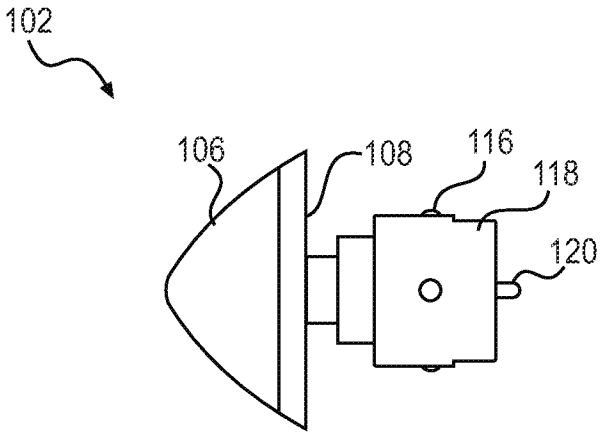

With reference now to FIGS. 3A-3D, shown are various views of an embodiment of nose 102. With reference to FIG. 3A and FIG. 3B, shown are front and rear perspective side views of a fully assembled nose 102. Shown are nose bumper 106, safety pin extension 108, firing pin assembly 118, ball bearings 116 and tip 120. Also shown is a notch (not labeled) in firing pin assembly 118; notch enables firing pin assembly 118 to be held by wrench during assembly. With reference to FIG. 3C, shown is a side view of nose 102, which illustrates the same components.

With reference now to FIG. 3D, shown is an exploded view of an embodiment of nose 102 in which components of nose 102 may be seen more clearly. As discussed above, nose 102 may include nose bumper 106 (which provides 'rebound' of SOBG 100 from target), safety pin extension 108 (which connects safety pin 112 to nose bumper 106), safety pin retainer 110 (which retains position of safety pin 112 in safety pin extension 108), safety pin 112 (which must be forcefully depressed with sufficient force to overcome inertia of compression spring 114 in order to activate firing pin 118), ball bearings 116 (which enable nose 102 to "snap" into body 104 and enable firing pin assembly 118 to move smoothly inside housing 122), firing pin assembly 118 (in which safety pin 112 rests prior to activation) and tip 120 which impacts primer/detonation cap 126, triggering delayed detonation of embodiment of SOBG 100.

Figure 4A:
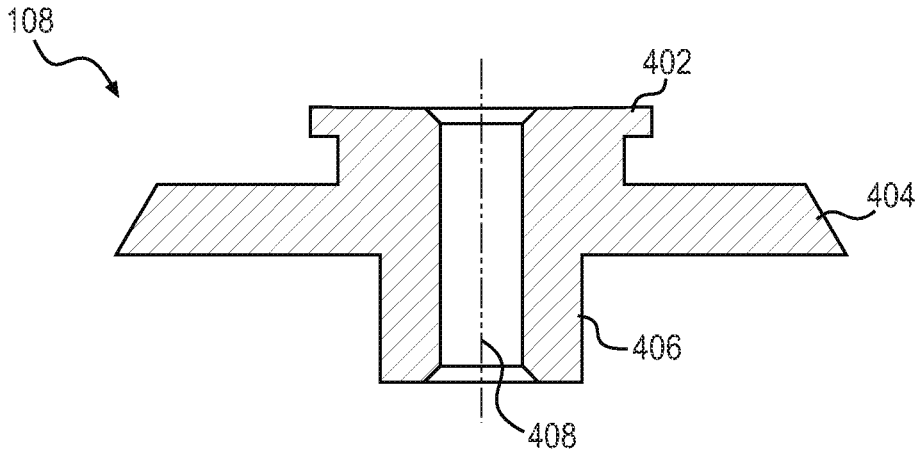
FIGS. 4A and 4B are diagrams illustrating a safety pin extension of an embodiment of a stand-off breaching device.
Figure 4B:
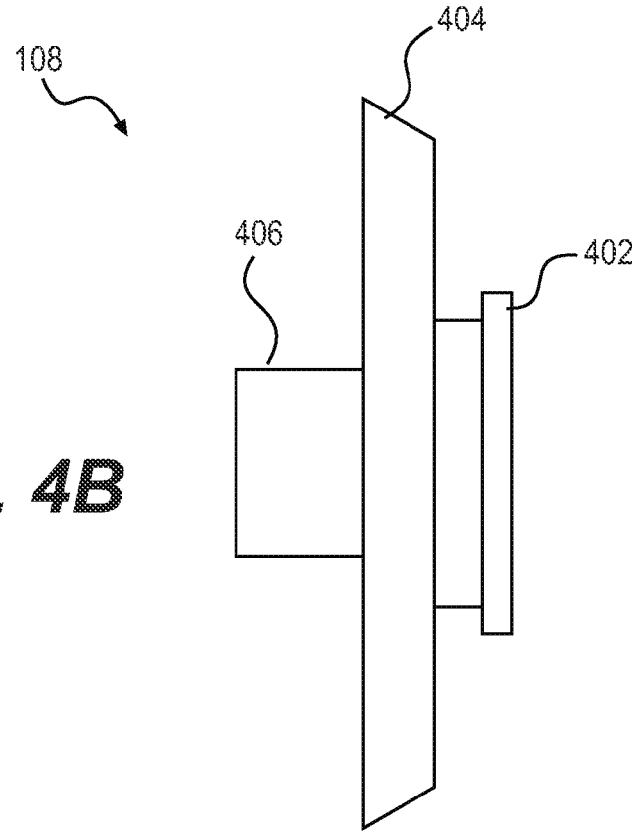

With reference now to FIGS. 4A-4B, shown are a cross-sectional side view and a side view of an embodiment of safety pin extension 108. As discussed above, safety pin extension 108 connects safety pin 112 to nose bumper 106. As seen in FIG. 4A, safety pin extension 108 includes a front portion 402 which may be used to secure safety pin extension 108 to nose bumper 106, a flange portion 404 that extends outwards and is designed to provide a continuous, aerodynamic surface between nose bumper 106 and body 104, and a safety pin sleeve 406, through which safety pin 112 extends. Safety pin sleeve 406 defines a safety pin cavity 408 into which safety pin 112 is inserted. As shown, safety pin cavity 408 extends through safety pin extension 108. This enables nose bumper 106 to come into contact with safety pin 112 when nose 102 impacts a target. In this manner, nose bumper 106 transfers sufficient force to safety pin 112 (i.e., force of impact) to depress safety pin 112 and overcome inertia of compression spring 114, thereby activating firing pin 118.

Figure 5:
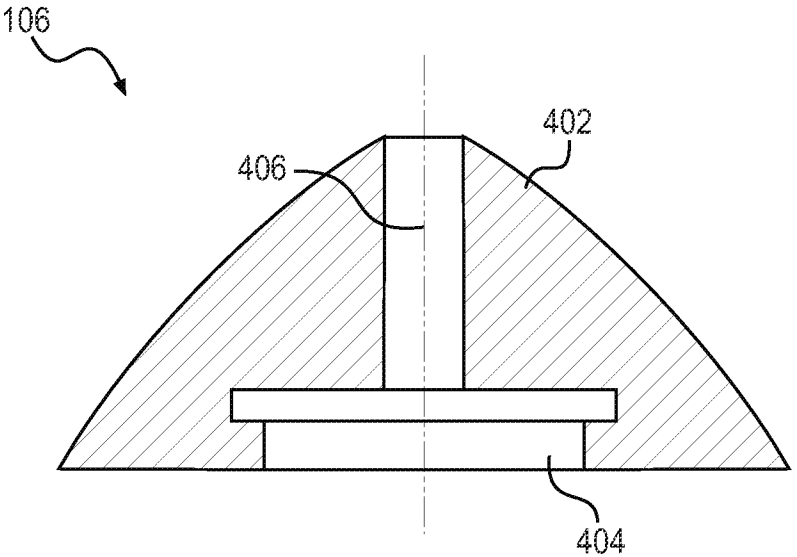
FIG. 5 is a diagram illustrating a cross-sectional view of a nose bumper of an embodiment of a stand-off breaching device.

With reference now to FIG. 5, shown is cross-sectional side view of an embodiment of nose bumper 106. Nose bumper 106 includes bumper portions 502 surrounding and defining a safety pin extension cavity 504 and a nose cavity 506. Safety pin extension cavity 504 is location in which front portion 402 of safety pin extension 108 is inserted to secure safety pin extension 108 to nose bumper 106. Safety pin 112 extends through safety pin extension 108 into safety pin extension cavity 504. A flat portion at top of safety pin extension cavity 504 (against which top of safety pin 112 rests) may be defined as shown. Nose cavity 506 is hollow portion of nose bumper 106 defined by bumper portions 502 at center of nose bumper 106, extending from tip of nose bumper 106 to safety pin extension cavity 504. Safety pin 112 rests against underside of nose bumper 106 at bottom of the nose cavity 506. In this configuration, impact force of nose 102 hitting target is more directly transferred to safety pin 112.

Figure 6A:
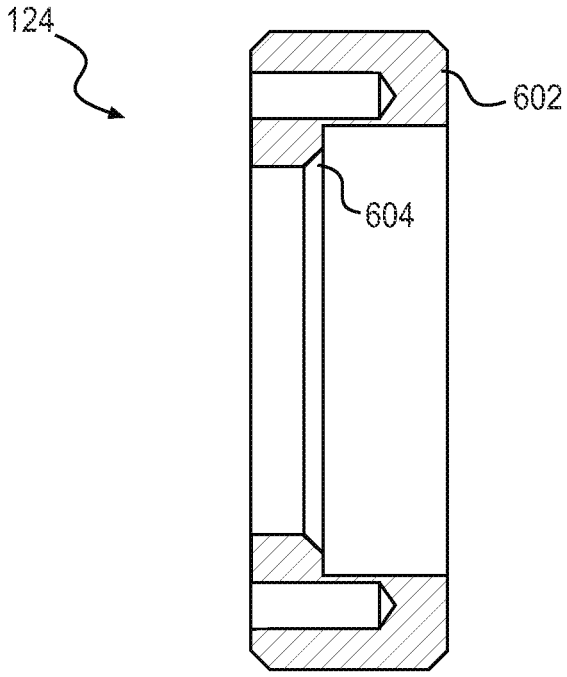
FIGS. 6A and 6B are diagrams illustrating a cross-sectional view and rear perspective view of a firing pin retainer of an embodiment of a stand-off breaching device.
Figure 6B:
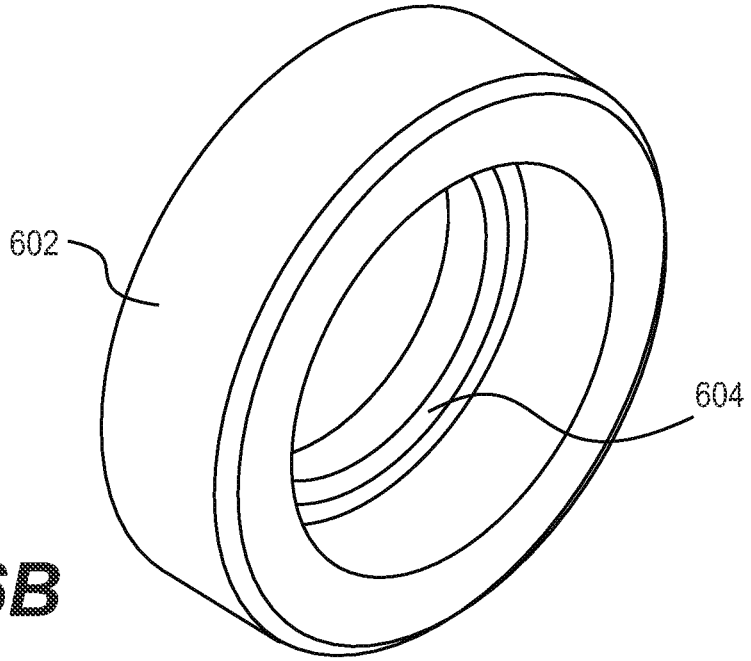

With reference now to FIGS. 6A and 6B, shown is a cross-sectional side view and a perspective rear-view of an embodiment of firing pin retainer 124. Firing pin retainer 124 is placed in firing pin cavity 204 of housing 122 and retains firing pin assembly 118 in place in housing 122. As shown, firing pin retainer 124 includes ring-shaped outer portion 602 and interior lip portion 604. Outer portion 602 rests in firing pin cavity 204. Interior lip portion 604 holds firing pin assembly 118 in place. Together, portion 602 and portion 604 define hollow area in which firing pin assembly 118 sits.

Figure 7:
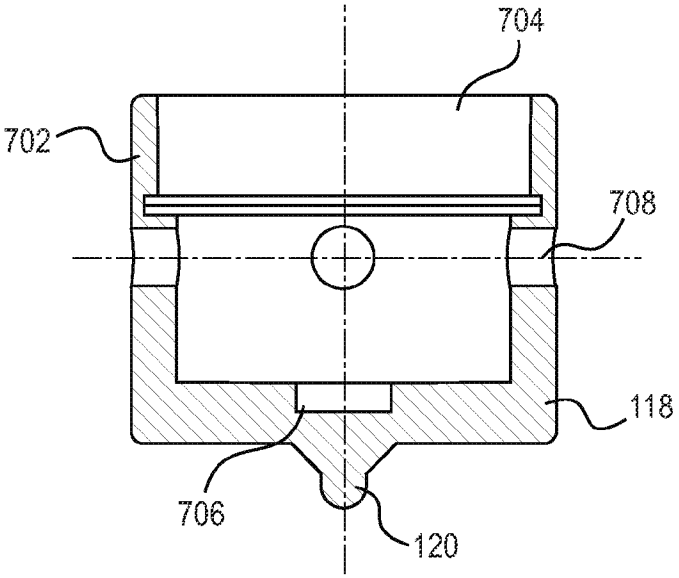
FIG. 7 is a diagram illustrating a cross-sectional view of a firing pin of an embodiment of a stand-off breaching device.

With reference now to FIG. 7, shown is a cross-sectional side view of an embodiment of firing pin assembly 118. Firing pin assembly 118 may be configured as a hollow cylinder-shape housing containing safety pin 112 and compression spring 114. Firing pin assembly 118 includes tip 120, as discussed above, housing walls 702 defining safety pin/spring cavity 704 and spring lodgment 706 and ball-bearing cavities 708. Compression spring 114 bottom end rests in spring lodgment 706 and extends upward into safety pin/spring cavity 704. Safety pin 112 rests against compression spring 114 in safety pin/spring cavity 704. Ball bearings 116 are situated in ball-bearing cavities 708.

Figure 8:
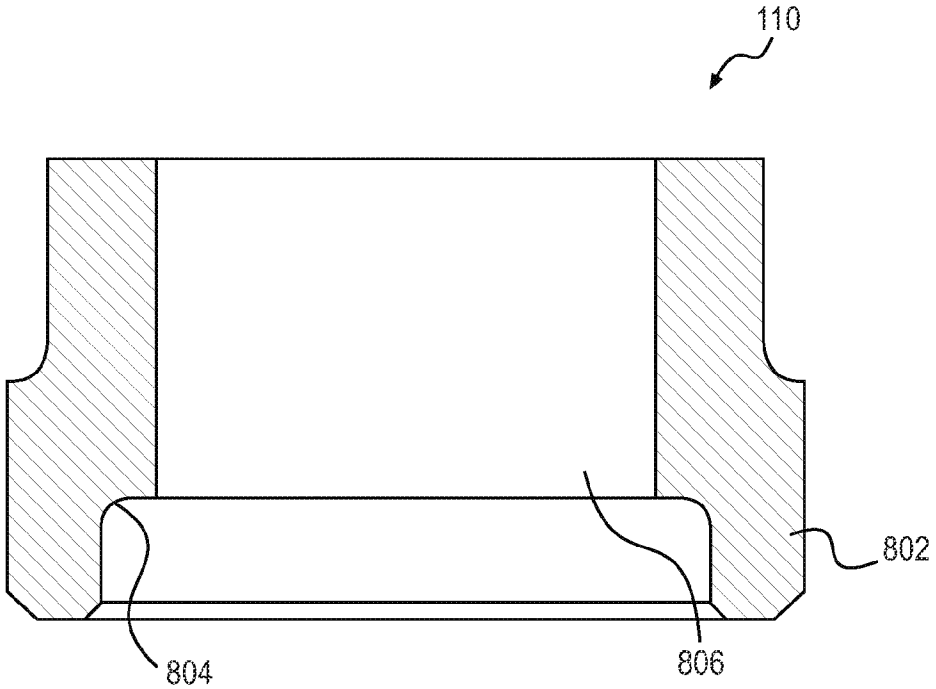
FIG. 8 a diagram illustrating a cross-sectional view of a safety pin retainer of an embodiment of a stand-off breaching device.

With reference now to FIG. 8, shown is a cross-sectional side view of an embodiment of safety pin retainer 110. Safety pin retainer 110 may be configured as a hollow cylinder-shape containing safety pin 112. Safety pin retainer 110 may include walls 802 that define retainer cavity 804 and retainer lip 806. Safety pin 112 extends through cavity 804, with wider portion of safety pin 112 resting against retainer lip 806.

Figure 9B:
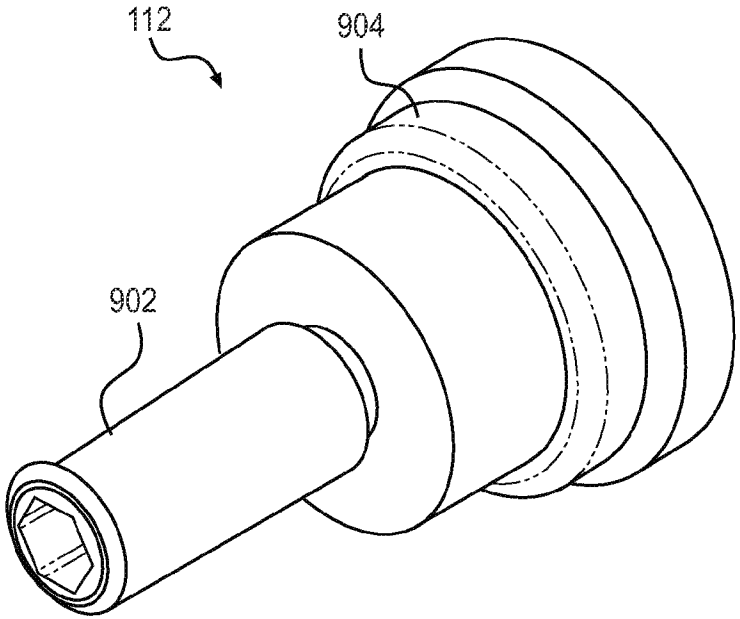
FIGS. 9A and 9B are diagrams illustrating a cross-sectional view and a perspective view of a safety pin of an embodiment of a stand-off breaching device.
Figure 9A:
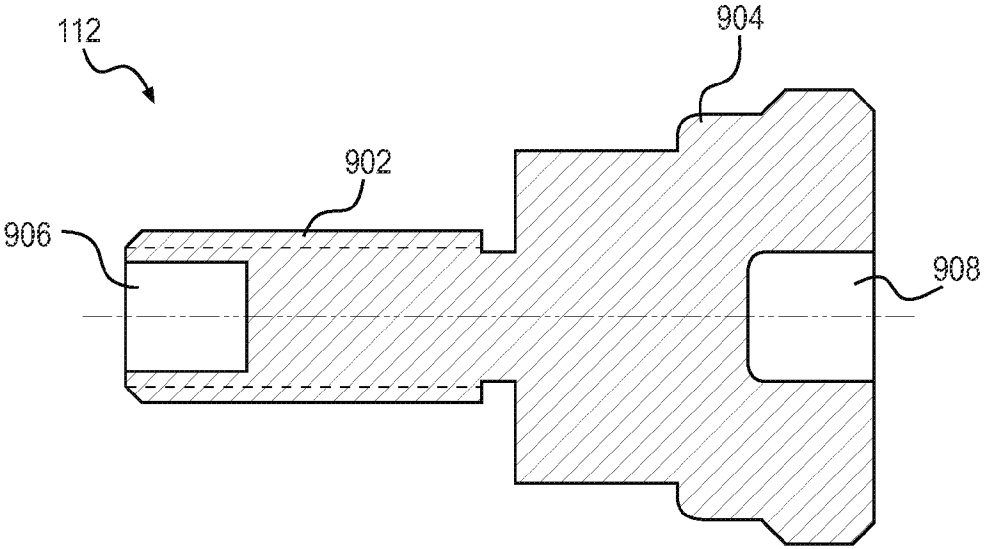

With reference now to FIGS. 9A-9B, shown are a cross-sectional side view and a perspective side view of an embodiment of safety pin 112. Safety pin 112 includes threaded portion 902 and gradually widening body portion 904. Threaded portion 902 extends through safety pin retainer 110, threads into safety pin extension 108 and into nose bumper 106, as described herein. Gradually widening body portion 904 rests against retainer lip 806 of safety pin retainer 110 and extends into safety pin/spring cavity 704 of firing pin assembly 118. Neck portion 902 defines neck cavity 904 which allows smooth transition for movement of ball bearings 116 during impact. Gradually widening body portion 904 defines spring cavity 908 in which compression spring 114 top end rests.

Figure 10A:
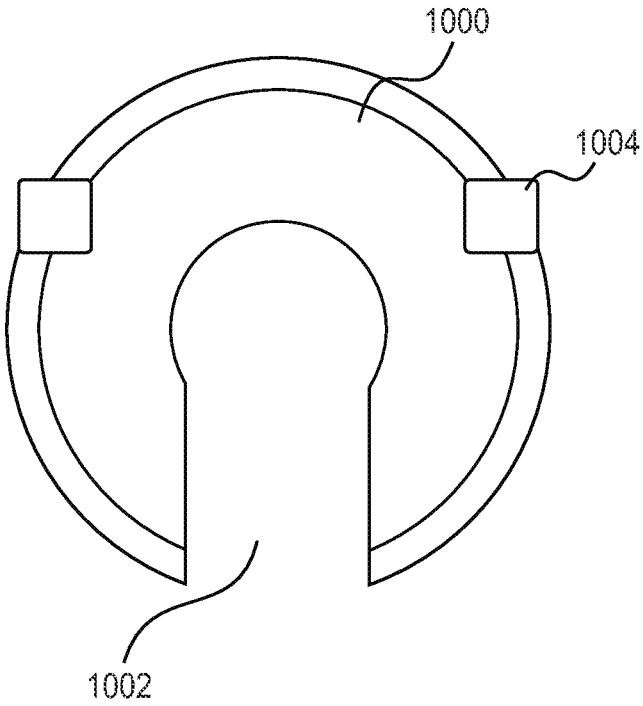
FIGS. 10A and 10B are diagrams illustrating a front view and a perspective view of a safety disk of an embodiment of a stand-off breaching device.
Figure 10B:
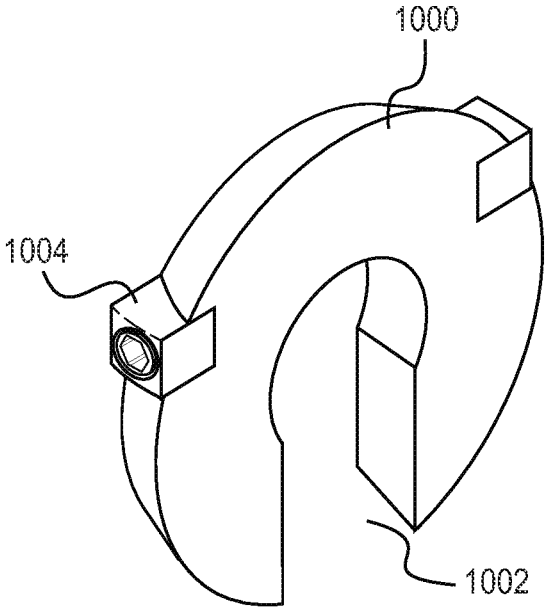

With reference now to FIGS. 10A-10B, shown are front and perspective side views of an embodiment of a safety disk assembly 1000. Safety disk assembly 1000 may be inserted into space between nose 102 and body 104 of an embodiment of SOBG 100. As shown, safety disk assembly 1000, or simply safety disk 1000, may define open end 1002 that is slid over and around portion of safety pin extension 108 and safety pin retainer 110 that are exposed in space between nose 102 and body 104. Placed in between nose 102 and body 104, safety disk 1000 prevents safety pin 112 from being depressed into firing pin 118. Safety disk 1000 also includes studs 1004 that enable safety disk 1000 to be pulled by hand. These studs 1004 may be omitted.

Figure 11A:
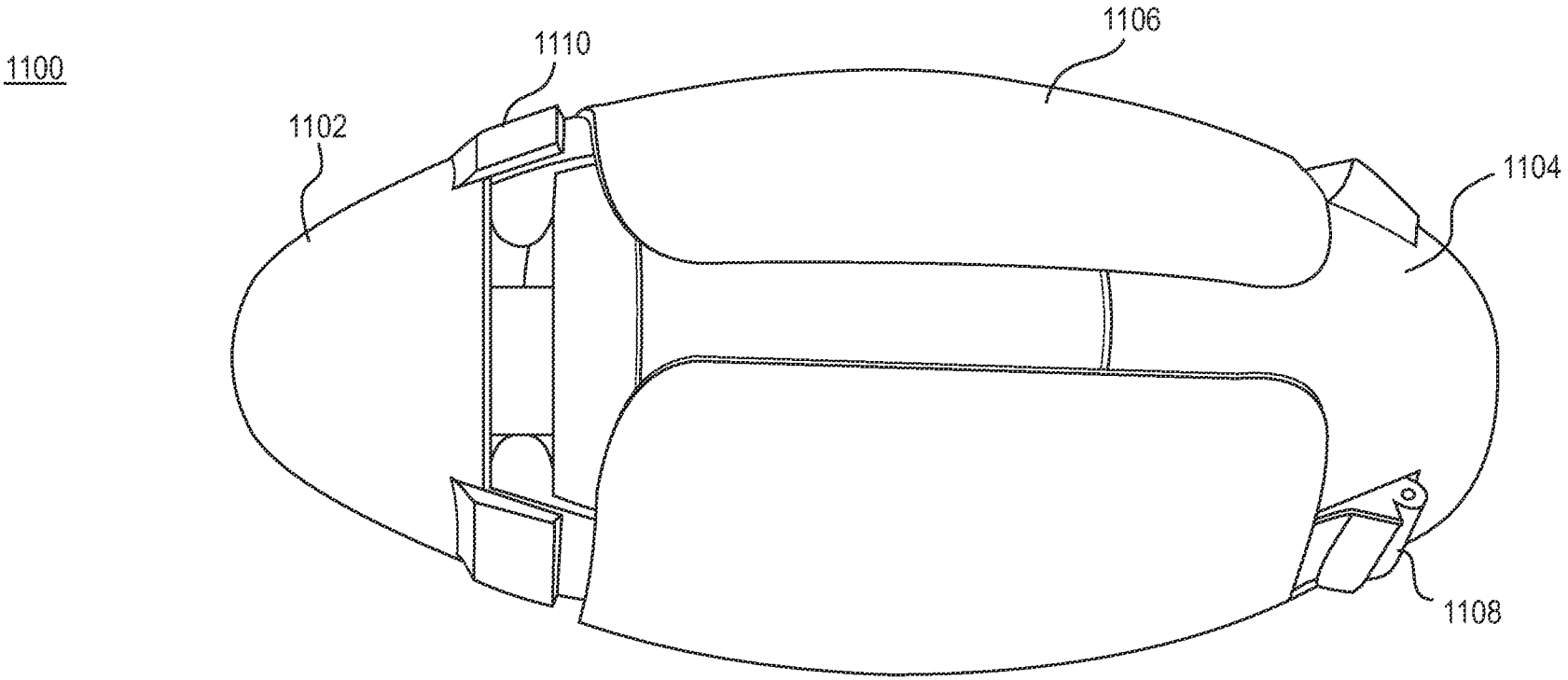
FIGS. 11A to 11C are diagrams illustrating an embodiment of a stand-off breaching device with fins.
Figure 11B:
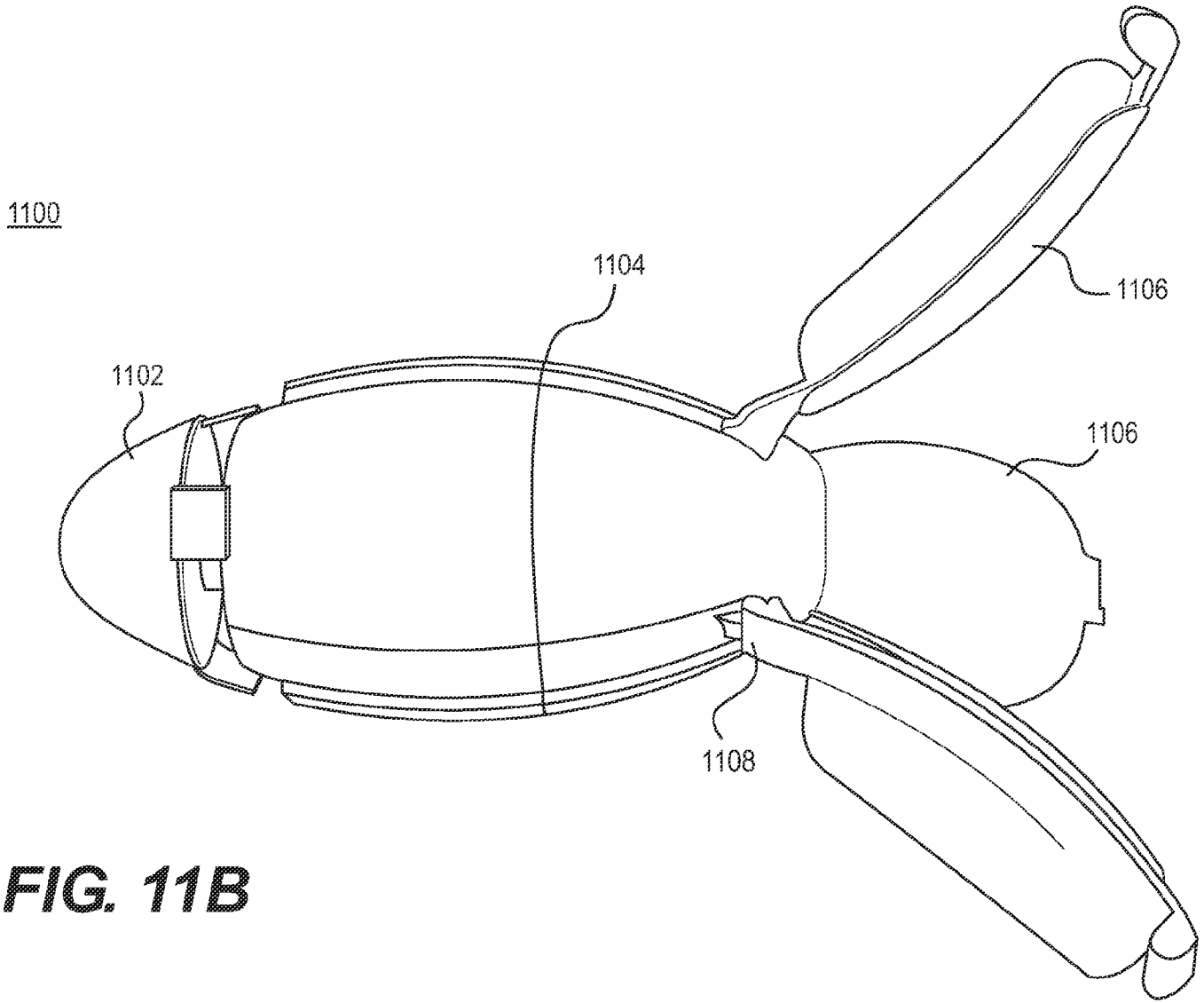
Figure 11C:
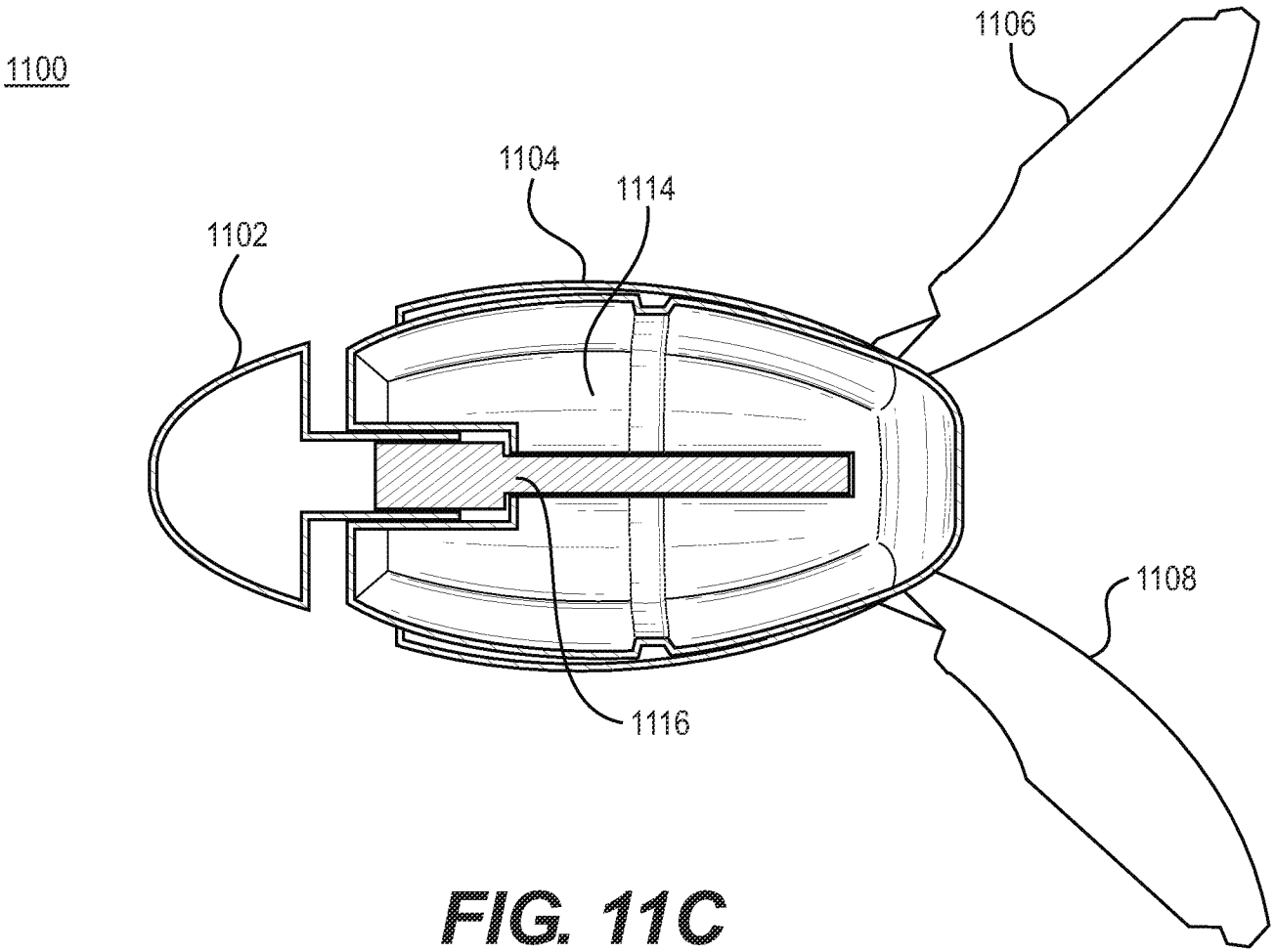

With reference now to FIGS. 11A-11C, shown are various views of an embodiment of a SOBG 1100 with fins. With reference to FIG. 11A, shown is a side view of an embodiment of SOBG 1100 with fins—fins not deployed. Embodiment of SOBG 1100 includes a nose 1102 and a body 1104, which may have characteristics and features similar to nose 102 and body 104 described above. For example, nose 1102 may include a bumper and SOBG 1100 may include a gap between nose 1102 and body 1104. This gap enables nose 1102 to compress into body 1104 upon impact with target, thereby triggering delay detonator. Body 1104 may be tapered at end opposite nose 1102, as shown. SOBG 1100 further includes fins 1106 which may be unfolded or deployed prior to throwing (or during launching) of SOBG 1100. Fins 1106 may provide more stable flight characteristics or impart other desired flight behavior(s) (e.g., such as spin) on SOBG 1100. Fins 1106 may be attached to body 1104 via, e.g., hinges 1108. SOBG 1100 may also include safety pin 1110 in gap between nose 1102 and body 1104. Pin 1110 may prevent nose 1102 from being compressed into body 1104, thereby preventing triggering of delay detonator, and is, therefore, removed before use of SOBG 1100.

With reference to FIG. 11B, shown is side view of an embodiment of SOBG 1100 with fins—fins deployed. As shown, embodiment of SOBG 1100 includes three fins 1106. When deployed or unfolded, fins 1106 extend from back of body 1104 opposite nose 1102 end of SOBG 1100. Other than fins 1106 and flight behavior(s) imparted by fins 1106, SOBG 1100 may perform as other embodiments of SOBG described herein—impacting on target, bouncing off to desired stand-off distance, and detonating.

With reference now to FIG. 11C, shown is a side, cross-sectional view of embodiment of SOBG 1100 with fins—fins deployed. As shown, body 1104 includes delay detonation mechanism 1116 and cavity 1114 that may contain main explosive fill. Also shown, nose 1102 includes extension that extends into body 1104 and triggers delay detonation mechanism 1116 upon impact with target. Delay detonation mechanism 1116 may be configured as described above or in a similar manner. Other delay detonation devices may be used.

As noted throughout, SOBG 100 shown and described herein is an embodiment. Many different variations on SOBG 100 are possible within the spirit of the invention. Variations based on payload, intended use (thrown or launched) or other conditions or factors may be taken into account when designing implementation of SOBG 100. Stand-off breaching devices according to the invention combine the breaching effectiveness of the SIMON device and GREM with the compactness of the Hell Hound while producing minimal fragmentation and minimal blast hazards for the operator. Such stand-off breaching devices accomplish this by bouncing off of target and delay detonating upon reaching ideal stand-off distance range. Such stand-off breaching devices accomplish this by being throw by hand or launched.

A typical SOBG 100, designed to be thrown, may weigh from 0.5 to 1.5 pounds and be approximately 2 to 6 inches in length and 1.5 to 3 inches in diameter. A typical SOBG 100, designed to be launched from a launcher, may weigh from 0.5 to 1.5 pounds and be approximately 2 to 6 inches in length and 1.5 to 3 inches in diameter. Variations of these ranges are possible and expected based on different types of launchers, different throwing conditions, etc.

Likewise, although shown is two separate components, nose 102 and body 104 may be formed as one continuous component. Additional features, such as fins, rifling, tapering of body, or other physical variations may be provided to improve or change performance and/or flight characteristics. Similar variations to the embodiments described herein, and components thereof, are apparent to those of ordinary skill in the art and may be implemented.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise indicated.

The invention claimed is:

1. A stand-off breaching device for breaching a target, the stand-off breaching device comprising:

a nose at a front end of the stand-off breaching device that is a rounded cone shape, wherein the nose is configured to compress and then rebound to its original shape exerting force against a target and the stand-off breaching device to cause the stand-off breaching device to rebound from the target after the nose impacts the target; and a body connected to the nose and extending to a back end of the stand-off breaching device, wherein the body includes:

a main explosive fill, wherein the main explosive fill is detonated and explodes to provide an explosive breaching force; and a delay detonator that detonates the main explosive fill and that is triggered when the nose impacts a target, wherein the delay detonator is configured to delay detonation of the main explosive fill until the stand-off breaching device has rebounded to a determined stand-off distance chosen to cause effective breaching of the target;

wherein the nose and body, and components of each, are fabricated from material that will be consumed by the explosion of the main explosive fill, minimizing any resultant fragments.

2. The stand-off breaching device of claim 1 wherein the nose and body form a continuous aerodynamic shape.

3. The stand-off breaching device of claim 1 wherein the nose includes a firing mechanism that is activated when nose impacts a target and which triggers the delay detonator.

4. The stand-off breaching device of claim 1 wherein the nose includes a rubber bumper that causes the stand-off breaching device to rebound from a target after impacting the target.

5. The stand-off breaching device of claim 1 wherein the body further includes a primer and a booster explosive, wherein the booster explosive detonates the main explosive fill after the delay detonator detonates.

6. The stand-off breaching device of claim 1 wherein the amount of main explosive fill and type of main explosive fill used are determined by the explosive breaching force necessary to breach a given target.

7. The stand-off breaching device of claim 1 wherein the nose and body components are primarily fabricated from polyoxymethylene ("POM").

8. The stand-off breaching device of claim 1 wherein the nose includes:

a nose bumper that causes the stand-off breaching device to rebound from a target after impacting the target;

a safety pin assembly connected to the nose bumper, wherein the safety pin assembly is configured to transfer force from the nose impacting a target;

a firing pin assembly that is situated within the body of the stand-off breaching device, wherein the safety pin assembly is partially situated within the firing pin assembly and spring-loaded by a compression spring so that when the nose impacts a target with sufficient force, the compression spring is compressed and the firing pin assembly is forced deeper within the body of the of the stand-off breaching device, triggering the delay detonator.

9. The stand-off breaching device of claim 8 wherein the safety pin assembly includes:

a safety pin extension that is connected to the nose bumper;

a safety pin that is situated partially within the safety pin extension and partially within the firing pin assembly; and a safety pin retainer that surround a portion of the safety pin.

10. The stand-off breaching device of claim 8 wherein the firing pin assembly includes:

a firing pin housing that contains the compression spring and the safety pin; and a tip, located at an end of the firing pin housing, that impacts delay detonator when the firing pin assembly is forced deeper within the body of the of the stand-off breaching device, triggering the delay detonator.

11. The stand-off breaching device of claim 8 wherein the body further includes:

a housing, wherein the housing defines a cavity containing the main explosive fill and delay detonator and a cavity in which the firing pin assembly is located;

a firing pin retainer that is situated in the housing and which retains the firing pin assembly; and, a back cap, situated in the housing, that seals a back end of the housing.

12. The stand-off breaching device of claim 1 wherein the nose and the body define a gap between nose and the body, the stand-off breaching device further comprising a removable safety disk position between the nose and the body in the gap that must be removed to use the stand-off breaching device.

13. The stand-off breaching device of claim 1 wherein the nose and body together are shaped like a ballistic shell.

14. The stand-off breaching device of claim 1 wherein the stand-off breaching device is configured to be launched from a standard grenade launcher.

15. The stand-off breaching device of claim 1, further comprising non-metal components.

16. The stand-off breaching device of claim 1 further comprising fins attached to the body, wherein fins are extended prior to use and impart flight behavior on stand-off breach device when thrown.

* * * * *